US005692874A

United States Patent [19]

Cordani et al.

[11] Patent Number: 5,692,874

[45] Date of Patent: Dec. 2, 1997

[54] GOODS-HANDLING DEVICE OF THE PUSH-PULL TYPE CAPABLE OF AUTOMATICALLY GRIPPING A LOAD-CARRYING SHEET

[75] Inventors: Arturo Cordani; Pier Luigi Magnelli, both of Piacenza, Italy

[73] Assignee: Bolzoni S.p.A., Italy

[21] Appl. No.: 598,863

[22] Filed: Feb. 9, 1996

[30] Foreign Application Priority Data

Feb. 10, 1995 [IT] Italy ..... MI95A0248

[51] Int. Cl.[6] ..... B66F 9/14

[52] U.S. Cl. ..... 414/661; 414/607

[58] Field of Search ..... 414/280, 661, 414/607; 294/104

[56] References Cited

U.S. PATENT DOCUMENTS

| | | | |
|---|---|---|---|
| 2,576,482 | 11/1951 | Rydner | 414/661 |
| 2,583,977 | 1/1952 | Turner | 414/661 |
| 2,601,932 | 7/1952 | Turner | 414/661 |
| 3,516,641 | 6/1970 | Ferguson | 414/661 |
| 4,482,286 | 11/1984 | Farmer et al. | 414/661 |
| 4,927,320 | 5/1990 | Olson | 414/661 |
| 5,316,433 | 5/1994 | Chase | 414/661 |
| 5,330,311 | 7/1994 | Cawley et al. | 414/661 |

*Primary Examiner*—Thomas J. Brahan

*Attorney, Agent, or Firm*—Shlesinger, Fitzsimmons & Shlesinger

[57] ABSTRACT

A handling device of the push-pull type for handling a load (17) disposed on a sheet-like loading unit (16) comprises a fixed portion (18) and a movable portion (19). Driven handling means (25) is present and has a first and a second operating strokes during which it translates the movable portion (19) relative to the fixed portion (18) from a retracted position to an extended position respectively, and vice versa. The movable portion (19) is provided with gripper means (15) capable of being drivingly opened and closed and intended for gripping the loading unit sheet (16) when the movable portion (19) is at the extended position and pulling the load between the extended and retracted positions. The driven handling means (25) is connected by a kinematic linkage with the gripper means (15) to cause opening and closing of the latter over at least one length of the operating strokes of said handling means.

16 Claims, 4 Drawing Sheets

GOODS-HANDLING DEVICE OF THE PUSH-PULL TYPE CAPABLE OF AUTOMATICALLY GRIPPING A LOAD-CARRYING SHEET

BACKGROUND OF THE INVENTION

The present invention relates to a device to be applied to lift trucks for handling of the goods stowed on loading units consisting of paperboard or plastics sheets. In the goods-handling field, loading units are known which are made of paper, paperboard or plastics sheets on which the goods are stacked.

For handling operations, lift trucks are used which are provided with pliers-shaped gripping devices for gripping one border of the sheet projecting frontally from the loading gauge and pulling it (together with the load itself) onto a support platform integral with the truck. Such gripping devices can be mounted to advantage, in case of need, to the same fork lift trucks utilized with known rigid pallets, which will enable important savings on equipment of the handling means in factories.

The push-pull devices of the known art for handling pallets in the form of sheets substantially consist of an extensible arm structure driven by an actuator generally of the hydraulic type, provided at one end with mechanical hooking members for manual attachment of said structure to the lift truck body and, at the other end, with a sheet-holding gripper, opening and closure of which are controlled by a second hydraulic actuator.

Since a separated hydraulic operation of the sheet-holding gripper is provided, the device is very complicated, due to the presence of the necessary guides, jacks, valves and pipelines. As a result, an important visibility limitation during operation occurs, and high costs and increased possibilities of failure are also involved.

It is noted that sequentiality in operation of the two systems is important in order to ensure a safe and sure gripping of the sheet before the load translation.

However, in the devices of the known art, adjustment of the operating sequence is made difficult due to a variable behaviour of the separated hydraulic systems depending on the equipment wear, the oil temperature in the circuits and the particular features of the sheets to be handled. It is a general object of the present invention to obviate the above mentioned drawbacks by providing a goods-handling device of the push-pull type in which movement of the extensible arms and the holding gripper is carried out by a single hydraulic system, of simple and inexpensive structure and minimum bulkiness, offering a sure and reliable sequentiality in operation.

SUMMARY OF THE INVENTION

In view of the above object, in accordance with the invention, a handling device of the push-pull type for handling of a load disposed on a sheet-like loading unit has been devised, which comprises a fixed portion and a movable portion, driven handling means having a first and a second operating strokes during which said means translates the movable portion relative to the fixed portion from a retracted position to an extended position respectively, and vice versa, gripper means being present on the movable portion, which means can be drivingly opened and closed and is intended for gripping the loading unit sheet when the movable portion is in the extended position and pulling the load between the extended and retracted positions, characterized in that the driven handling means is connected by a kinematic linkage to the gripper means to operate opening and closing of the latter over at least one length of the operating strokes of said handling means.

BRIEF DESCRIPTION OF THE INVENTION

For better explaining the innovatory principles of the present invention and the advantages it offers as compared with the prior art, a possible embodiment practising said principles will be given hereinafter, with the aid of the accompanying drawings, in which.

DETAILED DESCRIPTION OF THE INVENTION

Figure 1:
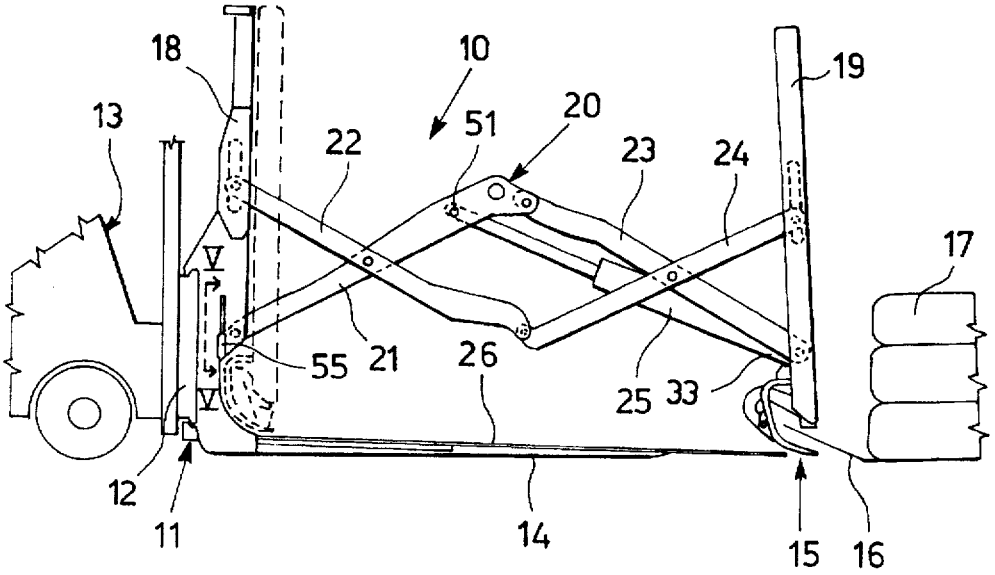
FIG. 1 is a diagrammic view in side elevation of a push-pull device according to the invention, mounted on a fork lift truck.

With reference to the drawings, a handling device of the push-pull type has been generally identified by 10 in FIG. 1. At the back, it has hooking means 11 for attachment to a support plate 12 of a known lift truck 13, of the fork type 14 for example, and at the front it is provided with gripper means 15 for holding fast and pulling a sheet-like loading unit 16. A load to be handled is shown only diagrammatically and denoted by 17.

Figure 4:
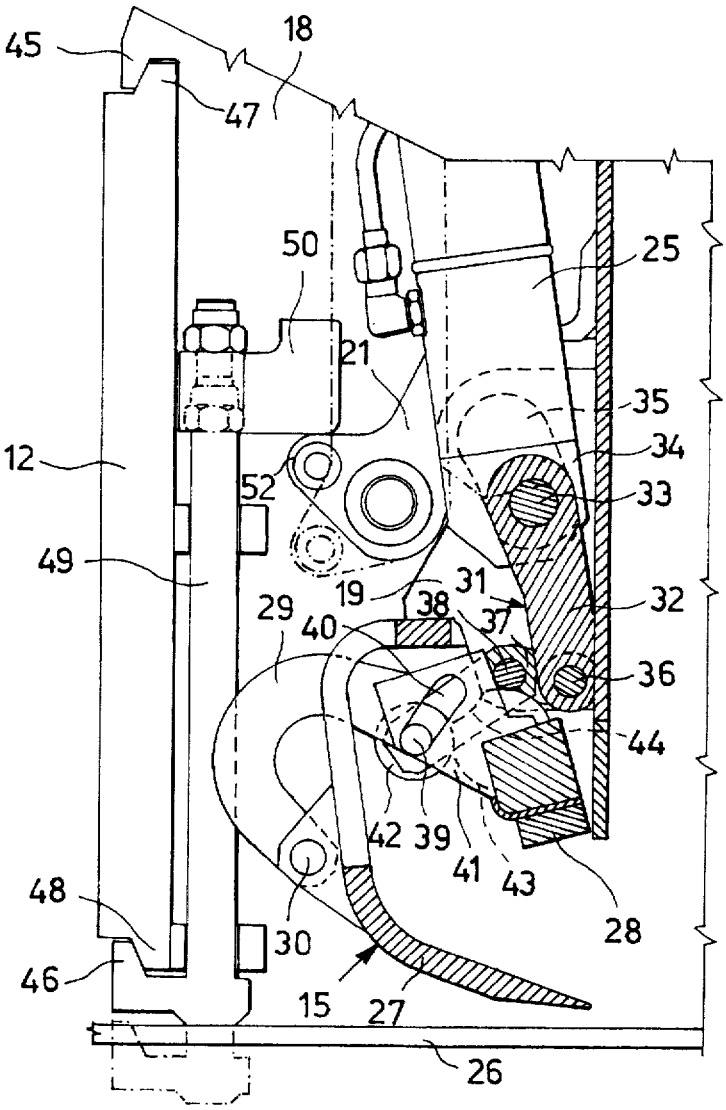
FIG. 4 is a view similar to the one in FIG. 2, the gripper being open and the hooking means being in a locked position.
Figure 2:
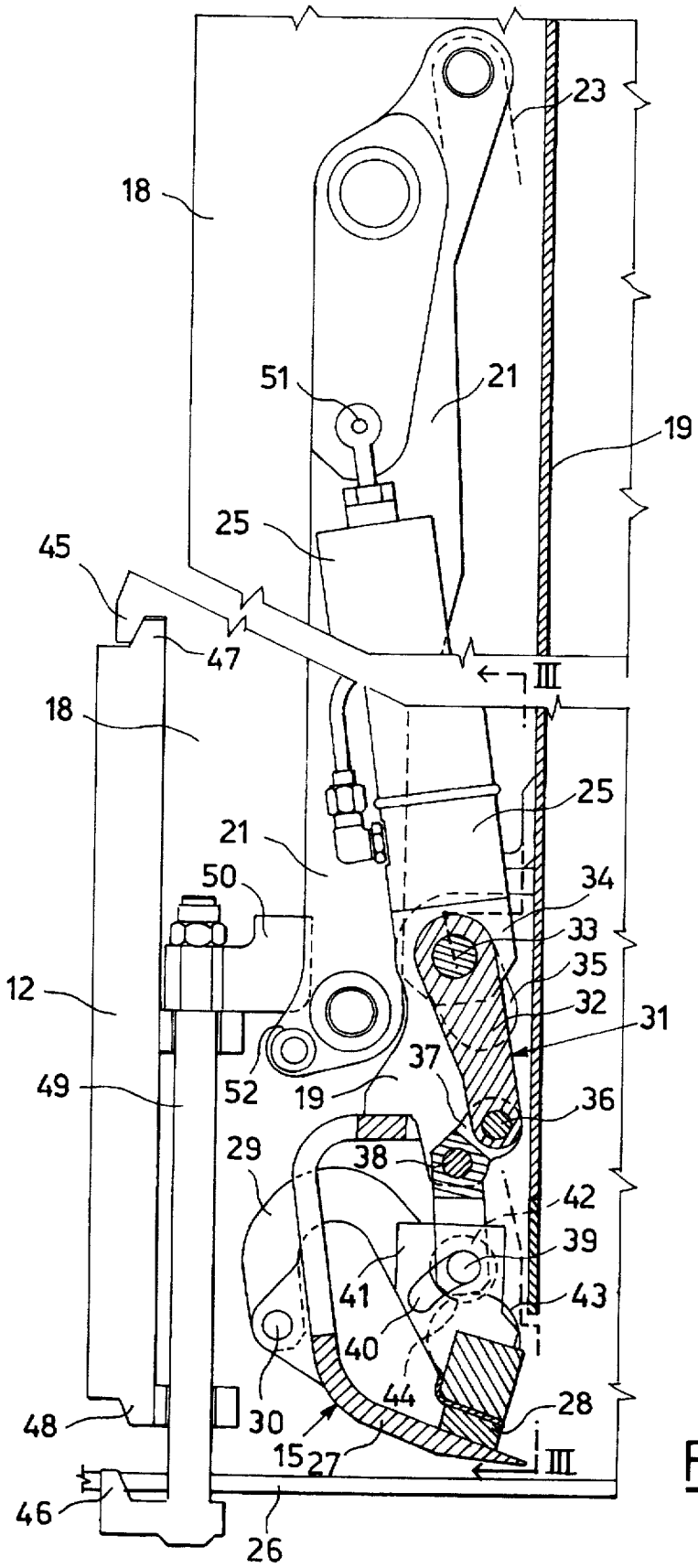
FIG. 2 is a partial sectional view in side elevation, sectioned along plane II—II in FIG. 3, of the device of FIG. 1 showing the arms in a retracted position and the holding gripper in a closed position.

The hooking means 11 for attachment to the lift truck is comprised of, as shown in FIGS. 2 and 4, upper hooks 45 and lower hooks 46, for engagement with corresponding upper 47 and lower 48 edges of the truck support 12.

Advantageously, the upper hook 45 is integral with a rear frame 18, whereas the lower hook 46 is part of a latch 49 vertically slidable with respect to said frame, from a first free position, shown in FIG. 2, to a second hooking position of the push-pull device, shown in solid line in FIG. 4.

Figure 5:
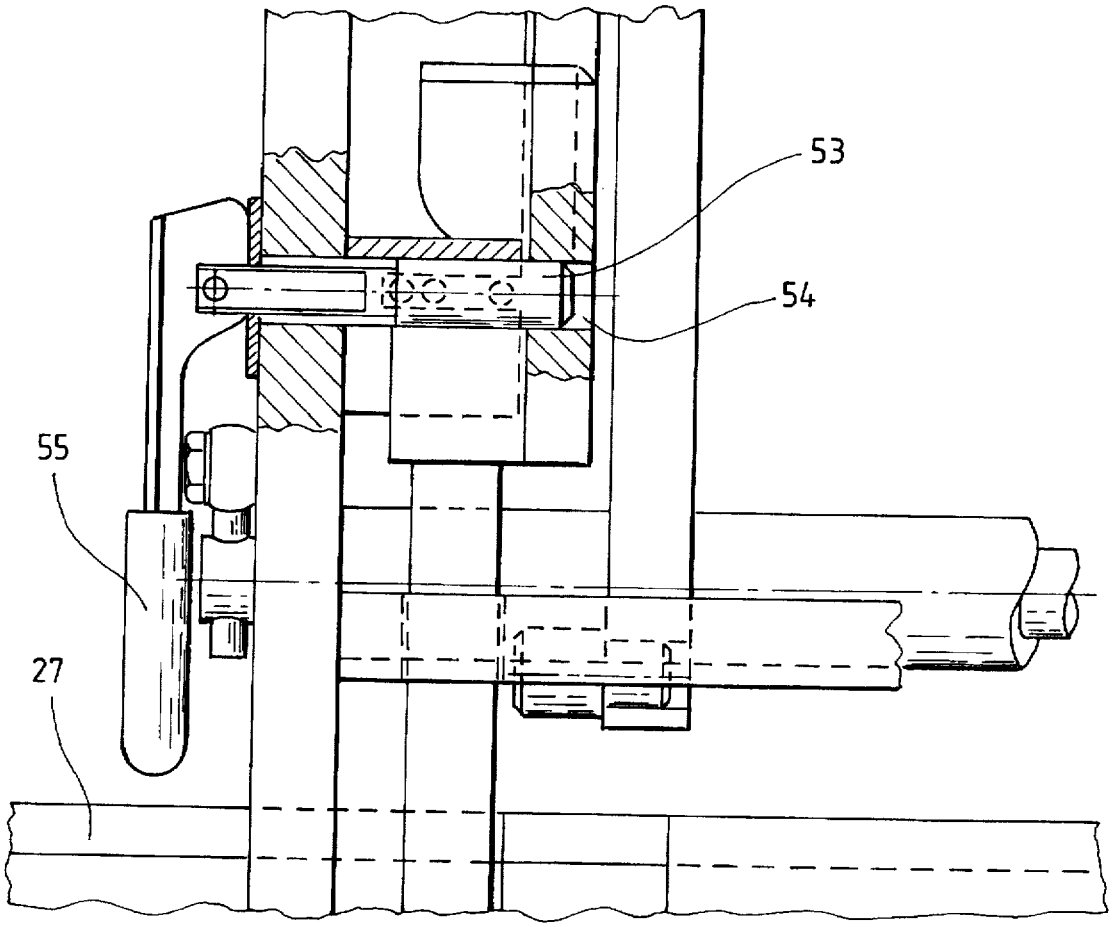
FIG. 5 is a partial view taken along plane V—V in FIG. 1.

A safety stud 53, shown in FIG. 5, is fitted into an appropriate seat 54 in latch 49 for firmly locking the latch 49, in known manner, to the position shown in FIG. 4.

The stud 53 keeps its stable locking position until a lever 55 is manually acted upon, when the truck is unloaded and the device is on the ground. Said lever 55, when so acted upon, by a known kinematic lever mechanism withdraws or releases the stud 53 from latch 49 and therefore the latch 49 is released so as to enable the push-pull device to be unhooked from the lift truck.

The hooking means 11 and gripper means 15 are supported by the rear frame or fixed portion 18 and a front plate or movable portion 19 for pulling or pushing the load, respectively. The frame 18 and plate 19 are connected with each other by an extensible pantograph structure 20, consisting of a first pair of arms 21, 22 articulated on each other and linked to the frame 18 by a hinge constraint and a carriage constraint respectively, and a second pair of arms 23, 24, articulated on each other and connected to the pushing or pulling plate 19 in the same way as before.

Extension of the arm structure 20 is caused to be driven by drive means comprising an actuator of a known type, a linear actuator for example, such as a hydraulic jack 25, connected between the arm 21 and plate 19.

Support and slide surfaces 26 for the loading unit 16 when said unit is being handled, project from the lower portion of the rear frame 18. Said support and slide surfaces 26, when the push-pull device is mounted on the lift truck, can in turn rest to advantage on the truck forks 14.

The sheet-like pallet gripper means 15 comprises a fixed jaw 27, integral with the plate 19, and a movable jaw 28 pivotally mounted on an axis 30, by means of arms 29, so that it rotates with respect to the fixed jaw 27 between a first position in which the gripper is closed, as shown in FIG. 2, and a second position in which the gripper is open, as shown in FIG. 4.

Figure 3:
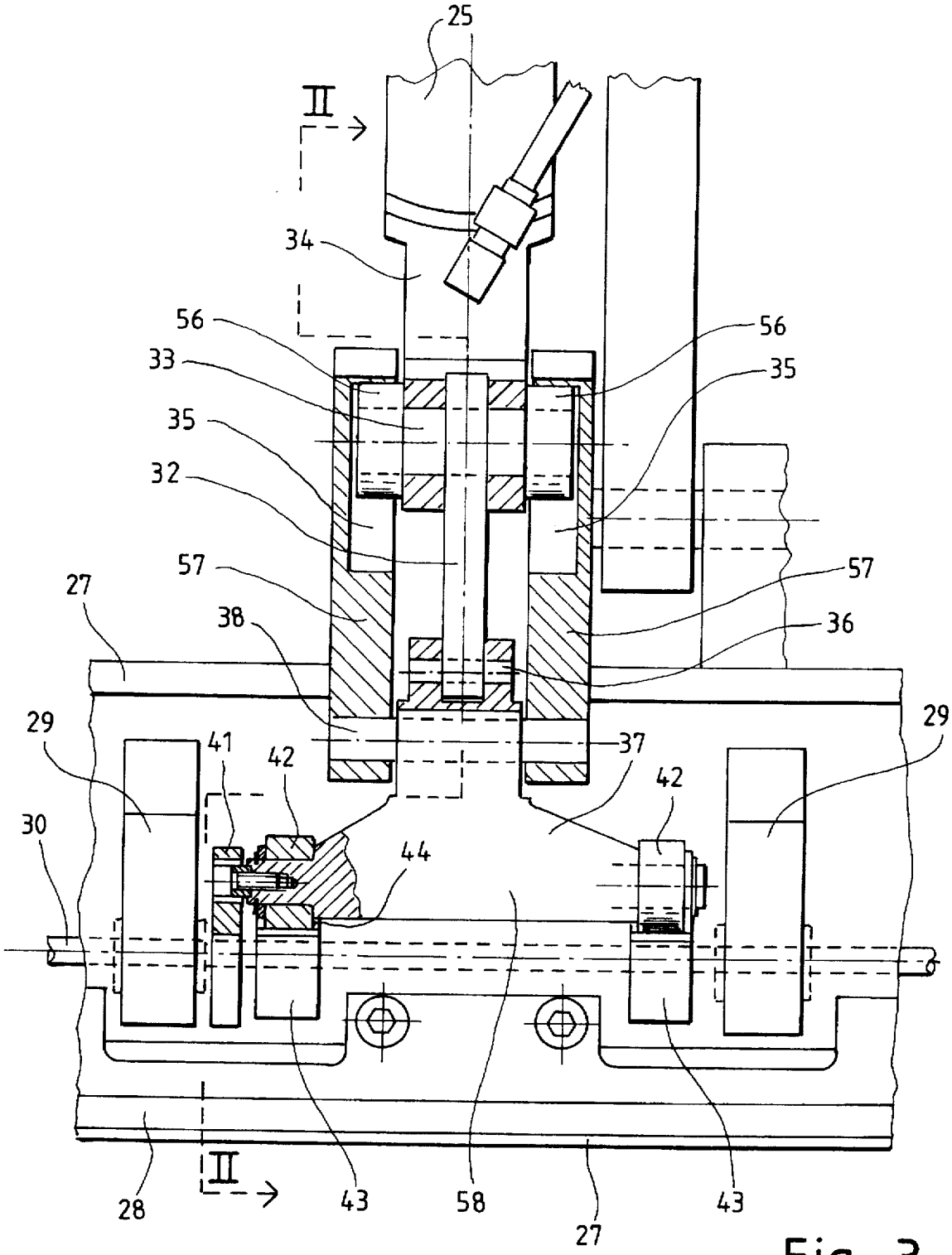
FIG. 3 is a partial front view of the push-pull device taken along section III—III of FIG. 2.

According to the invention, as shown in detail in FIGS. 2, 3 and 4, the drive means 25 is connected by a kinematic linkage to the gripper, in order to open and close it over at least one length of the operating stroke of said handling means. In fact, the hydraulic jack 25 has its end 34 connected to the plate 19 in a substantially slidable manner in the elongation direction. In particular the jack end 34 has a transverse pin 33 supporting slide rollers running in confronting slots 35 formed in plates 57 integral with the plate 19. A kinematic mechanism 31 is connected to the pin 33 to control the opening and closing movements of the gripper 15, on starting of the jack for extension or retraction of plate 19.

The kinematic mechanism 31 is comprised of a connecting rod 32 articulated at one end on pin 33 and at the other end, by a pin 36, on a primary lever 37, having its fulcrum at 38 on the plate 19.

The other end of lever 37 has a head 58 for operation of the jaw 28. The operating head 58 is laterally provided with a pin 39 engaging in a cam cavity 40 formed in a plate 41 integral with the movable jaw 28.

In addition, rollers 42 are also rotatably mounted sideways to the head 58 of lever 37, said rollers being designed to run or roll over curved surfaces 43 belonging to locking projections of the movable jaw 28. As clearly shown in FIG. 2, surfaces 43 each have therein an arcuate notch or locking portion 44 intended for furnishing seats or housings for rollers 42 when the jaws are closed, thereby forming a stable closure of the gripper itself.

The operating cycle of the push-pull device according to the invention will be now briefly described.

The device 10 is applied to the lift truck 13 by engagement of the upper hook 45 with the edge 47 of the truck support 12; the support surfaces 26 substantially rest on the truck forks 14.

By operating jack 25 through an appropriate drive lever located on the truck (not shown), the jack itself starts its expansion stroke and extends between its upper end 51 articulated on arm 21 and its lower end 34 engaging in the slots 35 of the front plate 19.

A first step or length of the elongation stroke of the jack is absorbed by sliding of the pin 33 in the slots 35, thereby causing movement of the kinematic mechanism 31 from the position in FIG. 2 to that in FIG. 4, which will bring about opening of gripper 15.

When the pin 33 has reached its lower end-of-stroke in slot 35, a further elongation of the jack causes the arm structure 20 to extend. When the arms are completely extended, the plate 19 is in the position shown in solid line in FIG. 1, the gripper being open.

At this point the lift truck takes such a position with respect to the load to be handled, that the projecting border of sheet 16 comes to a fitting position between the gripper jaws 27, 28.

The reverse operation of jack 25 causes a movement along the return stroke involving shortening of the jack from the position of FIG. 1. The first step or length of the shortening stroke is absorbed by sliding of the pin 33 in slots 35 towards the upper end-of-stroke, the kinematic mechanism 31 moving in the direction of closing the gripper 15. It is to note that insertion of rollers 42 into the locking portions 44 ensures a stable closing of the gripper itself.

Once pin 33 has reached the upper end-of-stroke in slots 35, further retraction of the jack rod its cylinder causes shortening of the arm structure 20, involving pulling of the load on the support surfaces 26. At the cycle end, the plate 19 is at the position shown in chain line in FIG. 1, the gripper 15 being closed.

For subsequent unloading of load 17, the arms 20 are extended again by operating the hydraulic jack 25. The arm extension, following reopening of the gripper, causes the loading unit to be pushed along the surface 26 by means of plate 19, until said unit is deposited to the desired position.

From the above description it is apparent that the intended purposes have been attained, in that a push-pull device has been developed which is provided with a simple and not very bulky mechanism for sequential operation of the arms and grippers.

According to a further innovatory feature of the present invention, the arm 21 is provided, advantageously close to its hinging point on frame 18, with a cam 52 (FIGS. 2 and 4) for egagment with and operation of a working projection 50 for the latch 49.

Cam 52 is such shaped that, during the initial extension step of the arm 21 to its position shown in FIG. 1, it enables its engagement with the working projection 50 in a manner capable of raising the latch 49 until the lower hook 46 reaches its hooking position on the edge 48 of the support plate 12, as shown in FIG. 2. As a result, when the panthograph arms are first actuated, the hooking system for attachment of the device to the truck is securely operated, even if the operator forgets to actuate the hooking system himself.

Obviously the above description of an embodiment applying the innovatory principles of the present invention is given by way of example only and therefore is not to be considered as a limitation of the scope of the invention as herein claimed.

For example, the movement actuator 25, herein embodied by a hydraulic jack, may consists of other known actuating means of the pneumatic, electrical or electromechanical type.

The movement transmission means from actuator 25 to the holding gripper may also comprise gears, chains, toothed belts and other known kinematic mechanisms, as a person of ordinary skill in the art can easily conceive.

In addition the hooking means for attachment of the device to the lift truck structure may also be of a typology different from the one shown.

Finally, the push-pull device may be conceived for being coupled with goods-handling systems other than fork trucks.

What is claimed is:

1. A load handling device for handling a load disposed on a load bearing sheet, comprising, load handling means having a fixed portion (18) and a movable portion (19), drive means (25) connected to said load handling means and having a first and a second operating stroke during which said drive means translates the movable portion with respect to the fixed portion from a retracted position to an extended position respectively, and vice versa; gripper means (15) mounted on the movable portion and operable to be drivingly opened and closed, and operative to grip a projecting portion of the sheet when the movable portion is in said extended position thereby to pull the load bearing sheet from an extended to a retracted position, and hooking means (11) mounted on the fixed portion (18) of the device for attaching said device to a transport apparatus and comprising, a pair of coupling elements (45, 46) for coupling said fixed portion (18) to a support (12) of the apparatus, at least one (46) of said coupling elements being movable between a first position in which it is free of said support and a second position in which said one element is stably hooked on the support, a working portion (50) on said one element (46) for effecting displacement thereof between said first and second positions, and pusher means (52) connected with the movable portion (19) of the device and acting on the working portion of said one coupling element so as to move said one element (46) from said first, free position thereof to said second, hooking position during movement of the movable portion (19) of said device from its retracted position to its extended position.

2. A device according to claim 1, characterized in that the drive means during a first position of its first operating stroke opens the gripper means and during a first position of its second operating stroke closes the gripper means.

3. A device according to claim 2, characterized in that said one end of said mechanism is connected to a slot in the movable portion for said limited movement relative thereto before moving the movable portion relative to the fixed portion, thereby to cause said kinematic linkage during such relative movement to open or close the gripper means.

4. A device according to claim 3, characterized in that the restricted-relative-movement means comprises a slidable carriage disposed between the handling end and movable portion.

5. A device according to claim 4, characterized in that the slidable carriage comprises a pair of rollers laterally projecting from the handling end for running in respective slots provided integral with the movable portion and substantially extended in the direction of the operating strokes.

6. A device according to claim 3, characterized in that the gripper means consists of a pair of jaws, one of which is integral with the movable portion, and the other one of which is rotatably mounted with respect to the first jaw and is connected to the kinematic linkage to be moved thereby between a first position in which the gripper jaws are closed and a second position in which said gripper jaws are open, due to said relative movement of said one end of said mechanism.

7. A device according to claim 1, characterized in that the drive means comprises a linear piston actuator.

8. A device according to claim 1, characterized in that the fixed portion and movable portion are interconnected by a pantograph structure.

9. A device according to claim 8, characterized in that the fixed portion comprises hooking means for attachment to a handling apparatus, which means consists of elements for coupling with a support of the apparatus, at least one of said coupling elements being drivingly movable between a first position in which it is free and a second position in which it is stably hooked on the support, the movable element being provided with a working portion for displacement between the first and second positions, pusher means connected with the movable portion acting on the working portion so as to bring the movable element from the free position to the hooking position during movement of the movable portion from the retracted position to the extended one.

10. A device according to claim 9, characterized in that the pusher means consists of a cam located on an arm of the pantograph structure, which cam engages the working portion at the end of the extension step of the pantograph structure.

11. A device according to claim 9, characterized in that said holding means comprises means for locking the movable element to the hooking position on the support.

12. A device according to claim 11, characterized in that said holding means comprises manual-release means for unlocking of the locking means to enable separation of the movable element from the support.

13. A device according to claim 1, characterized in that a horizontal extends from the fixed portion and forms a sliding surface on which the loaded sheet travels.

14. A device according to claim 13, characterized in that the movable portion comprises a pushing surface for discharging the load from surfaces on its movement between the retracted and extended positions.

15. A load handling device for handling a load disposed on a load bearing sheet, comprising load handling means having a fixed portion and a movable portion, drive means connected to said load handling means and having a first and a second operating stroke during which said drive means translates the movable portion with respect to the fixed portion from a retracted position to an extended position respectively, and vice versa, gripper means mounted on said movable portion to be drivingly opened and closed and operative for gripping a projecting portion of the load bearing sheet when the movable portion of the load handling means is in said extended position, and thereby to pull the load bearing sheet from an extended to a retracted position, and characeterized in that the drive means comprises a jack mechanism slidably connected at one end thereof to said movable portion for limited movement relative thereto, and connected by a kinematic linkage to the gripper mans on said movable portion, thereby functioning both to operate the opening and closing of the gripper means during the operating strokes of said drive means, and to drive said movable portion between said retracted and extended positions thereof, said drive means during a first portion of its first operating stroke opening the gripper means and during a first portion of its second operating stroke closing the gripper means, said one end of said jack mechanism being connected to a slot in the movable portion for said limited movement relative thereto before moving the movable portion relative to the fixed portion, thereby to cause said kinematic linkage during such relative movement to open or close the gripper means, said gripper means comprising a pair of jaws, one of which is integral with the movable portion and the other one of which is rotatably mounted with respect to the first jaw and is connected to the kinematic linkage to be moved thereby between a first position in which the gripper yaws are closed and a second position in which said gripper jaws are open, due to said relative movement of said one end of said mechanism, and characterized in that the kinematic linkage comprises a connecting rod hinged on the end of said mechanism and to one end of a lever respectively, said lever having its opposite end laterally fitted in a cam cavity integral with the movable jaw so that it carries out a rotation for opening and closing the gripper jaws respectively, due to the relative movement of the one end of said mechanism.

16. A device according to claim 15, characterized in that rollers are pivotally mounted on the opposite end of said lever, said rollers being designed to run over a surface belonging to a locking projection of the movable jaw, so as to act, when the gripper jaws are closed, upon a portion of said surface, which will push the gripper and make it achieve a stable closure.

* * * * *